US010012218B2

(12) United States Patent
Terauchi et al.

(10) Patent No.: US 10,012,218 B2
(45) Date of Patent: Jul. 3, 2018

(54) VARIABLE DISPLACEMENT COMPRESSOR AND SWASH PLACE LINKAGE CONNECTION

(71) Applicant: SANDEN CORPORATION, Isesaki-shi (JP)

(72) Inventors: Satoshi Terauchi, Isesaki (JP); Yukihiko Taguchi, Isesaki (JP)

(73) Assignee: SANDEN HOLDINGS CORPORATION, Gunma (JP)

( * ) Notice: Subject to any disclaimer, the term of this patent is extended or adjusted under 35 U.S.C. 154(b) by 232 days.

(21) Appl. No.: 14/397,427

(22) PCT Filed: Apr. 24, 2013

(86) PCT No.: PCT/JP2013/062095
§ 371 (c)(1),
(2) Date: Oct. 27, 2014

(87) PCT Pub. No.: WO2013/161887
PCT Pub. Date: Oct. 31, 2013

(65) Prior Publication Data

US 2015/0118073 A1 Apr. 30, 2015

(30) Foreign Application Priority Data

Apr. 25, 2012 (JP) ..... 2012-099900

(51) Int. Cl.
*F04B 1/29* (2006.01)
*F04B 27/10* (2006.01)
(Continued)

(52) U.S. Cl.
CPC ..... *F04B 1/295* (2013.01); *F04B 1/146* (2013.01); *F04B 27/1063* (2013.01);
(Continued)

(58) Field of Classification Search
CPC .. F04B 27/1804; F04B 53/18; F04B 27/0891; F04B 27/1045; F04B 27/0895;
(Continued)

(56) References Cited

U.S. PATENT DOCUMENTS 6,250,891 B1 6/2001 Kawaguchi et al.
6,283,722 B1 * 9/2001 Takenaka ..... F04B 27/1072 417/222.2
(Continued)

FOREIGN PATENT DOCUMENTS

DE 19961767 12/1999
DE 112008001475 7/2010
(Continued)

OTHER PUBLICATIONS

German Patent Application 112013002240 Office Action dated Sep. 12, 2016.

*Primary Examiner* — Essama Omgba
*Assistant Examiner* — Stephen Mick
(74) *Attorney, Agent, or Firm* — Cozen O'Connor

(57) ABSTRACT

A variable displacement compressor having means for regulating the minimum inclination angle of a swash plate, a spring urging the swash plate in the inclination angle-increasing direction, and a spring urging the swash plate in the inclination angle-decreasing direction. The swash plate inclination angle is θa as the sum of the urging forces of both springs is zero, when the drive shaft is not rotated; and, when the drive shaft is rotated, its inclination angle is θb at which the sum of moments MS, MF is zero. Moment MS of rotational motion is based on selling the product of inertia in the variable-angle direction of the swash plate to decrease the inclination angle of the swash plate from θa. Moment MF is based on the combined urging force of both springs
(Continued)

set so that the inclination angle θb is positioned at a minimum angle at maximum rotational speed.

2 Claims, 5 Drawing Sheets

(51) Int. Cl.
*F04B 27/18* (2006.01)
*F04B 1/14* (2006.01)

(52) U.S. Cl.
CPC ..... *F04B 27/1072* (2013.01); *F04B 27/1804* (2013.01); *Y10T 29/49236* (2015.01)

(58) Field of Classification Search
CPC ..... F04B 2027/1845; F04B 2027/1831; F04B 1/295; F04B 1/146; F04B 27/1063; F04B 27/1072; F04B 1/20; F04B 7/02; F04B 2027/1813; F04B 2027/1822; F04B 2027/1827; F04B 2027/185; Y10T 29/49236
USPC ..... 417/218, 222.1, 222.2, 270
See application file for complete search history.

(56) References Cited

U.S. PATENT DOCUMENTS

| | | | | |
|---|---|---|---|---|
| 6,425,741 | B1 * | 7/2002 | Mera | F04B 27/1054 417/222.2 |
| 8,353,680 | B2 | 1/2013 | Schaefer et al. | |
| 2002/0141880 | A1 * | 10/2002 | Ahn | F04B 27/1054 417/222.2 |
| 2009/0178552 | A1 * | 7/2009 | Kawamura | F04B 27/1072 91/505 |
| 2010/0209261 | A1 * | 8/2010 | Lee | F04B 27/1072 417/222.1 |
| 2011/0020147 | A1 * | 1/2011 | Onda | F04B 27/1804 417/269 |
| 2012/0073430 | A1 * | 3/2012 | Uchikado | F04B 27/1054 91/183 |

FOREIGN PATENT DOCUMENTS

| | | |
|---|---|---|
| JP | 2000-002180 | 1/2000 |
| JP | 2010-168959 | 8/2010 |
| JP | 2011-27115 | 2/2011 |
| WO | WO2008/119319 | 10/2008 |
| WO | WO2008/146806 | 12/2008 |

* cited by examiner

VARIABLE DISPLACEMENT COMPRESSOR AND SWASH PLACE LINKAGE CONNECTION

RELATED APPLICATIONS

This is a U.S. National stage of International application No. PCT/JP2013/062095 filed on Apr. 24, 2013.

This patent application claims the priority of Japanese application no. 2012-099900 filed Apr. 25, 2012, the disclosure content of which is hereby incorporated by reference.

FIELD OF THE INVENTION

Background Art of the Invention

The present invention relates to a variable displacement compressor for compressing refrigerant and a method for manufacturing the same, and specifically, to a variable displacement compressor suitable for use in an air conditioning system for vehicles and a method for manufacturing the same.

A variable displacement compressor having a swash plate an inclination angle of which can be controlled variably, used in an air conditioning system for vehicles, is well known (for example, Patent documents 1 and 2). In particular, in Patent document 1, a variable displacement compressor is disclosed in which a swash plate is designed so that a moment of rotational movement acts in an inclination angle increasing direction when an inclination angle of the swash plate is smaller than a predetermined inclination angle (θs), and when the inclination angle of the swash plate is greater than the predetermined inclination angle (θs), the moment of rotational movement acts in an inclination angle decreasing direction, and the minimum inclination angle is regulated so that the minimum inclination angle of the swash plate is controlled at the predetermined inclination angle (θs).

PRIOR ART DOCUMENTS

Patent Documents

Patent document 1: JP-A-2010-168959
Patent document 2: JP-B-3783434

SUMMARY OF THE INVENTION

Problems to be Solved by the Invention

A moment of rotational movement based on a product of inertia in a variable-angle direction of the swash plate is proportional to a square of a rotational speed of the swash plate, that is, a square of a rotational speed of the compressor. Even if the product of inertia in the variable-angle direction of the swash plate is set at a small value, an influence thereof cannot be ignored when the rotational speed of the compressor increases, and it becomes a great value in a high-speed rotation region. Therefore, in the high-speed rotation region, the moment of rotational movement based on the product of inertia in the variable-angle direction of the swash plate gives a great influence on a variable-angle motion of the swash plate.

In a linking body 400 having an inclination angle decreasing spring and an inclination angle increasing spring shown in FIG. 2 of Patent document 1, when the drive shaft is rotated, the moment of rotational movement based on the product of inertia in the variable-angle direction of the swash plate, and a moment operating on the swash plate in the variable-angle direction based on a combined force of urging forces of the springs shown in FIG. 4, act on the swash plate.

In this Patent document, however, because the values of the moment of rotational movement based on the product of inertia in the variable-angle direction of the swash plate and the moment acting on the swash plate in the variable-angle direction based on the combined force of the urging forces of both springs are not clear, it is unclear how the inclination angle of the swash plate is changed from an inclination angle θa (θa: an inclination angle of the swash plate at which the sum of the urging force of the inclination angle decreasing spring and the urging force of the inclination angle increasing spring becomes zero in a state where the rotation is stopped.) when rotation operation is performed from the rotation-stopped state through a high-speed rotation region, and consequently, the best way to suppress an increase in power consumption of the compressor in the high-speed rotation region is not shown.

In light of the above-described conventional technology, an object of the present invention is, specifically, to provide a variable displacement compressor in which an increase in power consumption of the compressor in a high-speed rotation region is suppressed, and a method for manufacturing the compressor.

Means for Solving the Problems

In order to achieve the above-described object, the present invention provides a variable displacement compressor having

- a housing in which a discharge chamber, a suction chamber, a crank chamber and cylinder bores are defined,
- pistons inserted into the cylinder bores,
- a drive shaft supported rotatably in the housing,
- a rotor fixed synchronously rotatably to the drive shaft,
- a swash plate which is linked with the rotor via a linking means, and which is rotated synchronously with the rotor and attached slidably to the drive shaft so that an inclination angle thereof is changed relatively to an axis of the drive shaft,
- a minimum inclination angle regulating means for regulating a minimum inclination angle of the swash plate to approximately 0°, when the inclination angle of the swash plate orthogonal to the axis of the drive shaft is defined as 0°,
- an inclination angle increasing spring for urging the swash plate in a direction of increasing the inclination angle from the minimum inclination angle,
- an inclination angle decreasing spring for urging the swash plate in a direction of decreasing the inclination angle from a maximum inclination angle through the minimum inclination angle,
- a conversion mechanism disposed between the pistons and the swash plate for converting rotational motion of the swash plate into reciprocating movement of the pistons, and
- a control valve for controlling a pressure in the crank chamber, which changes the inclination angle of the swash plate by varying a pressure difference between the crank chamber and the suction chamber to adjust a stroke of the pistons, compresses a refrigerant sucked from the suction chamber into cylinder bores and discharges a compressed refrigerant into the discharge chamber, characterized in that a linking body of the drive shaft on which the inclination angle increasing spring and the inclination angle decreasing spring are mounted, the rotor, the linking means and the swash plate is configured so that;

when the drive shaft is not rotated, the inclination angle of the swash plate is positioned at a predetermined inclination angle θa at which a sum of an urging force of the inclination angle decreasing spring and an urging force of the inclination angle increasing spring becomes zero; and when the drive shaft is rotated, a moment of rotational motion MS based on a setting of a product of inertia in a variable-angle direction of the swash plate acts in the inclination angle decreasing direction to decrease the inclination angle of the swash plate from the predetermined inclination angle θa, and whereby a moment MF based on a combined force of the urging force of the inclination angle decreasing spring and the urging force of the inclination angle increasing spring acts in the inclination angle increasing direction, thereby the inclination angle of the swash plate being positioned autonomously at a predetermined inclination angle θb at which a sum of the moment MS and the moment MF becomes zero, wherein the urging force of the inclination angle increasing spring, the urging force of the inclination angle decreasing spring and the product of inertia in the variable-angle direction of the swash plate are set so that the predetermined inclination angle θb is positioned at a minimum angle in a range of inclination angle where compression operation can be securely performed at the time of a maximum rotational speed.

In such a variable displacement compressor according to the present invention, when the inclination angle of the swash plate at the time of the maximum rotational speed is represented by θb(Nmax), a relation between values of the inclination angle θb at which the swash plate is positioned autonomously when the rotational speed is not the maximum rotational speed, the above-described θa and the θb(Nmax) becomes θa>θb≥θb(Nmax). Therefore, even if the rotational speed of the compressor increases and the inclination angle of the swash plate is changed in a decreasing direction by the product of inertia in the variable-angle direction of the swash plate, the autonomously positioned inclination angle θb of the swash plate does not become smaller than θb(Nmax) in an autonomously positioned state. The urging force of the inclination angle increasing spring, the urging force of the inclination angle decreasing spring and the product of inertia in the variable-angle direction of the swash plate are set so that the θb(Nmax) becomes a minimum angle in a range of inclination angle where compression operation is securely performed at the time of the maximum rotational speed. In other words, the urging force of the inclination angle increasing spring, the urging force of the inclination angle decreasing spring and the product of inertia in variable-angle direction of the swash plate are set so that the compression operation is performed securely to securely cause a discharge pressure in the discharge chamber, and that the θb(Nmax) becomes a minimum angle in an operation-guaranteed range where the inclination angle of the swash plate can be changed securely by controlling the pressure difference between the crank chamber and the suction chamber using a control valve for controlling the amount of discharge gas introduced into the crank chamber. Therefore, even if the inclination angle of the swash plate reaches an angle near a mechanical minimum inclination angle (approximately 0°) transitionally in a high-speed rotation region including the maximum rotational speed, since the above-described moment MF and the moment MS ensure that the inclination angle of the swash plate can be returned to the inclination angle θb (for example, approximately 1°) at which the compression operation is performed securely, it is possible to avoid occurrence of an impossible condition for displacement control. In addition, because the inclination angle θb (approximately 1°) is a minimum angle in the range of inclination angle where the compression operation is performed securely, the power consumption of the variable displacement compressor in a high-speed rotation region near its maximum rotational speed can be reduced most efficiently and securely. At the same time, because an increase in pressure in the crank chamber is suppressed to a minimum degree, it also becomes possible to promote an improvement in lifetime of a shaft sealing device for the drive shaft, etc.

Further, because the linking body is actually rotated, the inclination angle θb at the maximum rotational speed can be positioned at a minimum angle (for example, approximately 1°) in a range of inclination angle where the compression operation is performed securely in a state including influences of a fluctuation of the product of inertia in the variable-angle direction of the swash plate, fluctuations of the urging force of the inclination angle decreasing spring and the urging force of the inclination angle increasing spring, and friction forces generated at the linking means and a sliding portion between the swash plate and the drive shaft.

In the variable displacement compressor according to the present invention, as described above, a target value of the above-described predetermined inclination angle θb at the maximum rotational speed can be set at approximately 1°.

Further, in the variable displacement compressor according to the present invention, as the above-described linking means, a link mechanism having a structure in which the link mechanism has a link arm for linking the rotor with the swash plate can be employed. In a variable displacement compressor having a link mechanism, it is necessary to consider an influence of a link arm that affects the product of inertia in the variable-angle direction of the swash plate, and the product of inertia fluctuates more broadly than other hinge structures having no linking arm. Therefore, the manner of the present invention in which the linking body is actually rotated to confirm the inclination angle θb at the maximum rotational speed is suitable for such a variable displacement compressor having a link mechanism.

Furthermore, the present invention also provides a method for manufacturing a variable displacement compressor having a housing in which a discharge chamber, a suction chamber, a crank chamber and cylinder bores are defined, pistons inserted into the cylinder bores, a drive shaft supported rotatably in the housing, a rotor fixed synchronously rotatably to the drive shaft, a swash plate which is linked with the rotor via a linking means, and which is rotated synchronously with the rotor and attached slidably to the drive shaft so that an inclination angle thereof is changed relatively to an axis of the drive shaft, a minimum inclination angle regulating means for regulating a minimum inclination angle of the swash plate to approximately 0°, when the inclination angle of the swash plate orthogonal to the axis of the drive shaft is defined as 0°, an inclination angle increasing spring for urging the swash plate in a direction of increasing the inclination angle from the minimum inclination angle, an inclination angle decreasing spring for urging the swash plate in a direction of decreasing the inclination angle from a maximum inclination angle through the minimum inclination angle, a conversion mechanism disposed between the pistons and the swash plate for converting rotational motion of the swash plate into reciprocating movement of the pistons, and a control valve for controlling a pressure in the crank chamber, which changes the inclination angle of the swash plate by varying a pressure difference between the crank chamber and the suction chamber to adjust a stroke of the pistons, compresses a refrigerant sucked from the suction chamber into cylinder bores and discharges a compressed refrigerant into the discharge chamber, characterized in that a linking body of the drive shaft on which the inclination angle increasing spring and the inclination angle decreasing spring are mounted, the rotor, the linking means and the swash plate is configured so that;

when the drive shaft is not rotated, the inclination angle of the swash plate is positioned at a predetermined inclination angle θa at which a sum of an urging force of the inclination angle decreasing spring and an urging force of the inclination angle increasing spring becomes zero, and when the drive shaft is rotated, a moment of rotational motion MS based on a setting of a product of inertia in a variable-angle direction of the swash plate acts in the inclination angle decreasing direction to decrease the inclination angle of the swash plate from the predetermined inclination angle θa, and whereby a moment MF based on a combined force of the urging force of the inclination angle decreasing spring and the urging force of the inclination angle increasing spring acts in the inclination angle increasing direction, thereby the inclination angle of the swash plate being positioned autonomously at a predetermined inclination angle θb at which a sum of the moment MS and the moment MF becomes zero, wherein the urging force of the inclination angle increasing spring, the urging force of the inclination angle decreasing spring and the product of inertia in the variable-angle direction of the swash plate are set so that the predetermined inclination angle θb is positioned at a minimum angle in a range of inclination angle where compression operation can be securely performed at the time of a maximum rotational speed.

Effect According to the Invention

Thus, in the present invention, while the variable-angle motion of the swash plate of the variable displacement compressor can be secured ensurely up to the maximum rotational speed, the increase of power consumption of the compressor in a high-speed rotation region can be suppressed efficiently.

EMBODIMENTS FOR CARRYING OUT THE INVENTION

Hereinafter, embodiments of the present invention will be explained with reference to the accompanying drawings.

(1) Variable Displacement Compressor

Figure 1:
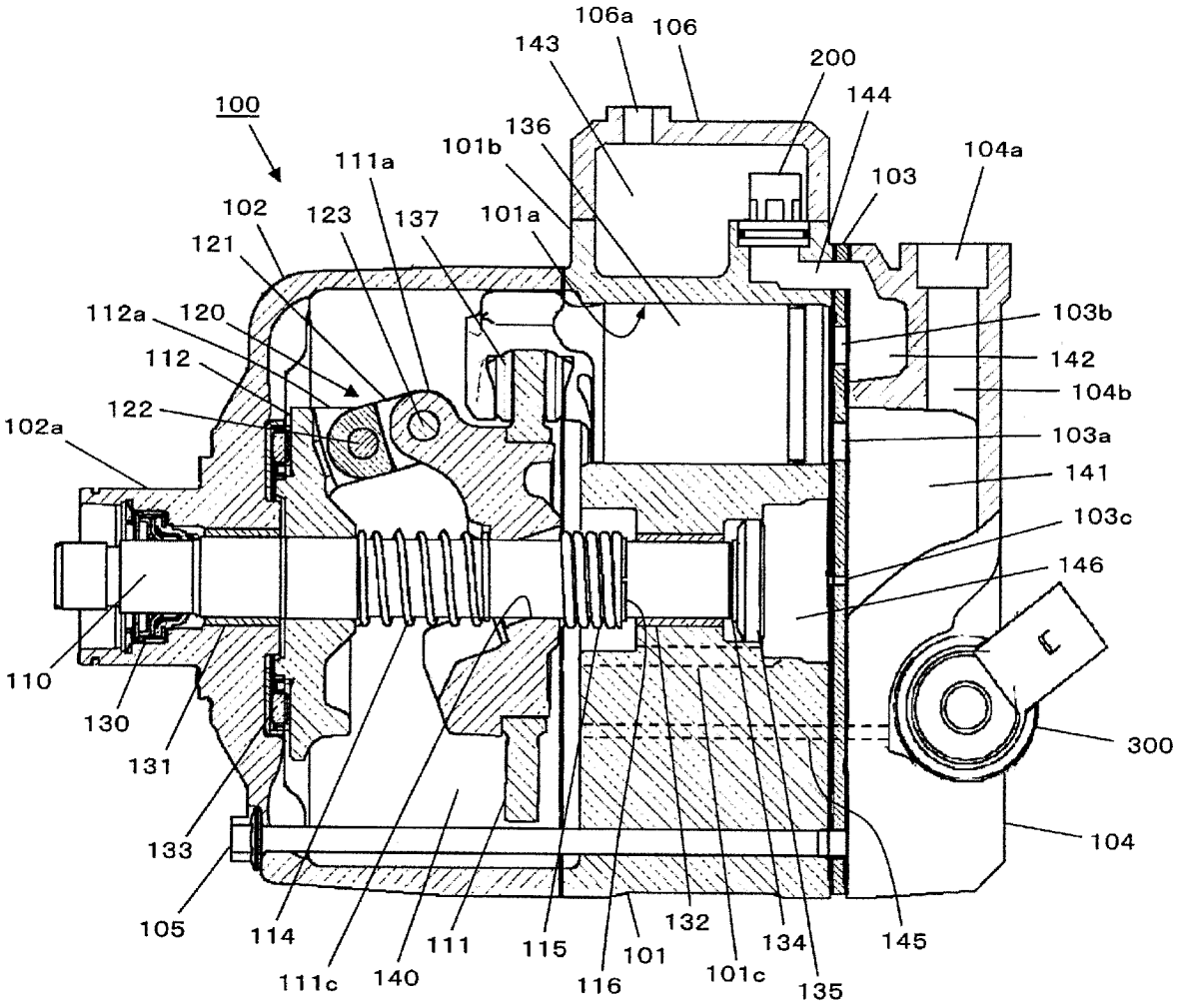
FIG. 1 is a vertical sectional view of a variable displacement compressor according to an embodiment of the present invention.

FIG. 1 depicts a variable displacement compressor according to an embodiment of the present invention used in an air conditioning system for vehicles. A variable displacement compressor 100 depicted in FIG. 1 is a clutchless compressor, and it has a cylinder block 101 having a plurality of cylinder bores 101*a*, a front housing 102 provided at one end of cylinder block 101, and a cylinder head 104 provided at the other end of cylinder block 101 via a valve plate 103.

A drive shaft 110 is disposed across a crank chamber 140 defined by cylinder block 101 and front housing 102, and around a central portion in its axial direction, a swash plate 111 is disposed. Swash plate 111 is linked to a rotor 112 fixed to drive shaft 110 via a link mechanism 120, and the inclination angle thereof can be changed along drive shaft 110.

Link mechanism 120 comprises a first arm 112*a* projected from rotor 112, a second arm 111*a* projected from swash plate 111, and a link arm 121 in which a side of one end is linked rotatably to first arm 112*a* via a first link pin 122 and a side of the other end is linked rotatably to second arm 111*a* via a second link pin 123.

A through hole 111*c* of swash plate 111 is formed into such a shape that swash plate 111 can be inclined in a range from a maximum inclination angle (θmax) to a minimum inclination angle (θmin), and in through hole 111*c*, a maximum inclination angle regulating portion and a minimum inclination angle regulating portion each coming into contact with drive shaft 110 are formed.

Where, in this embodiment, for example, a clutchless compressor having a maximum discharge capacity of approximately 160 cc is supposed, and when an inclination angle of the swash plate at the time at which swash plate 111 is orthogonal to drive shaft 110 is defined as 0°, the minimum inclination angle regulating portion in through hole 111*c* is formed so that the inclination angle of swash plate 111 becomes approximately 0°. Where, "the minimum inclination angle θmin is approximately 0°" means a region greater than −0.5° and smaller than 0.5°, however, it is preferred that the region is set in a range from 0° or greater to smaller than 0.5°. Further, the maximum inclination angle regulating portion in through hole 111*c* is formed so that the inclination angle of swash plate 111 is present in a range from 20° to 21°.

Between rotor 112 and swash plate 111, an inclination angle decreasing spring 114 comprising a compression coil spring for urging swash plate 111 down to the minimum inclination angle is attached, and between swash plate 111 and a spring support member 116, an inclination angle increasing spring 115 comprising a compression coil spring for urging swash plate 111 in a direction to increase the inclination angle of the swash plate 111 up to a predetermined inclination angle smaller than the maximum inclination angle is attached. Because the urging force of inclination angle increasing spring 115 at the minimum inclination angle is set greater than the urging force of the inclination angle decreasing spring 114, when drive shaft 110 is not rotated, swash plate 111 is positioned at a predetermined inclination angle θa at which a combined force of the urging force of the inclination angle decreasing spring 114 and the urging force of the inclination angle increasing spring 115 becomes zero (FIG. 2).

Figure 2:
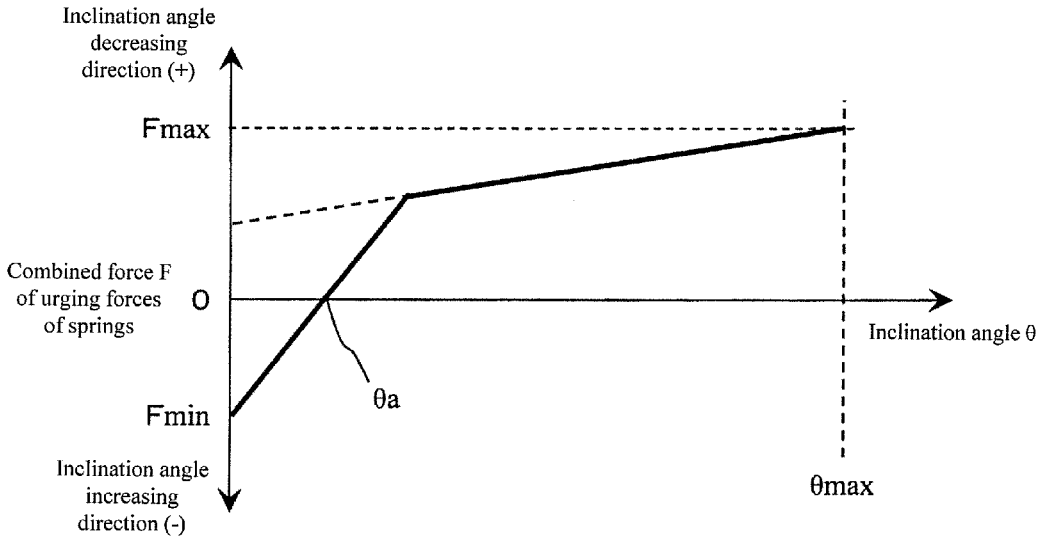
FIG. 2 is a graph indicating a relationship between a combined force of an urging force of an inclination angle decreasing spring and an urging force of an inclination angle increasing spring and the inclination angle in the variable displacement compressor depicted in FIG. 1.

Where, a combined force Fmin of the urging forces at the minimum inclination angle θmin and the predetermined inclination angle θa shown in FIG. 2 are set in consideration of smooth shift from an OFF state (an air conditioning system non-working state) of the clutchless compressor to an ON state (the air conditioning system working state) at a rotational speed of the compressor corresponding to that at an idling of a vehicle (for example, 700 rpm), and are set to be as small as possible in order to reduce power consumption in the OFF state. Because the predetermined inclination angle θa must be in a region where the compression operation is performed securely, it is set in a region greater than 1° and smaller than 5° so as to avoid an excessive load of the compressor at the time of starting an engine. It is preferred that the predetermined inclination angle θa is set in a range of 2° to 3°, and that Fmin is set in a range of approximately −40N±15N (the minus sign represents the inclination angle increasing direction). The combined force Fmax of the urging forces at the maximum inclination angle θmax is set in a range of approximately 60N±15N.

One end of drive shaft 110 extends up to the outside through the inside of a boss part 102*a* of front housing 102 projecting outside, and is connected to a power transmitting device which is not shown in the figure. Where, a shaft sealing device 130 is inserted between drive shaft 110 and boss part 102*a*, and it seals the inside from the outside. Drive shaft 110 and rotor 112 are supported by bearings 131, 132 in the radial direction and by a bearing 133 and a thrust plate 134 in the thrust direction. A power from an external drive source is transmitted to the power transmitting device, and drive shaft 110 can be rotated synchronously with a rotation of the power transmitting device. Where, a gap between a portion contacted with thrust plate 134 of drive shaft 110 and thrust plate 134 is adjusted to a predetermined gap by an adjusting screw 135.

Each piston 136 is disposed in each cylinder bore 101*a*, the radially outer portion of swash plate 111 is contained in an internal space formed at one end of piston 136 projecting to a side of crank chamber 140, and swash plate 111 is configured to work in conjunction with piston 136 via a pair of shoes 137. Therefore, pistons 136 can be reciprocated in cylinder bores 101*a* in accordance with the rotation of swash plate 111.

In cylinder head 104, defined are a suction chamber 141 at a central portion in the radial direction and a discharge chamber 142 annularly surrounding the radial outside of suction chamber 141. Suction chamber 141 communicates with cylinder bore 101*a* via a communication hole 103*a* formed on valve plate 103 and a suction valve (not shown in the figure), and discharge chamber 142 communicates with cylinder bore 101*a* via a discharge valve (not shown in the figure) and a communication hole 103*b* formed on valve plate 103.

A compressor housing is formed by fastening front housing 102, cylinder block 101, valve plate 103 and cylinder head 104 with a plurality of through bolts 105 via gaskets which are not shown in the figure.

A muffler is provided at an upper portion of cylinder block 101 in FIG. 1. The muffler is formed by fastening a lid member 106 to a formed wall 101*b* defined and formed in an upper portion of cylinder block 101 with bolts via a seal member which is not shown in the figure. A check valve 200 is disposed in a muffler space 143. Check valve 200 is disposed at a connecting portion between a communication path 144 and muffler space 143, works in response to a pressure difference between communication path 144 (an upstream side) and muffler space 143 (a downstream side), closes communication path 144 when the pressure difference is smaller than a predetermined value, and opens communication path 144 when the pressure difference is greater than the predetermined value. Thus, discharge chamber 142 is connected to a discharge side of a refrigeration cycle in the air conditioning system via a discharge path formed from communication path 144, check valve 200, muffler 143 and a discharge port 106*a*.

A suction port 104*a* and a communication path 104*b* are formed in cylinder head 104, and suction chamber 141 is connected to a suction side of a refrigeration cycle in the air conditioning system via a suction path formed from communication path 104*b* and suction port 104*a*. The suction path extends linearly from the radial outside of cylinder head 104 across a part of discharge chamber 142.

A control valve 300 is further provided in cylinder head 104. Control valve 300 adjusts an opening degree of a communication path 145 communicating between discharge chamber 142 and crank chamber 140, and controls an amount of discharged gas introduced into crank chamber 140. Further, the refrigerant in crank chamber 140 flows into suction chamber 141 through a communication path 101*c*, a space 146 and an orifice 103*c* formed on valve plate 103.

Therefore, by changing the pressure in crank chamber 140 by control valve 300 to change the inclination angle of swash plate 111, namely, strokes of pistons 136, it is possible to variably control the displacement for discharge of variable displacement compressor 100.

When the air conditioning system is operated, that is, in a state where variable displacement compressor 100 is operated, the amount of electricity applied to a solenoid incorporated in control valve 300 is adjusted based on an external signal, and the displacement for discharge of variable displacement compressor 100 is controlled variably so that the pressure in suction chamber 141 becomes a predetermined value. Control valve 300 can control the suction pressure in an optimum manner in accordance with an external environment.

Further, when the air conditioning system is not operated, that is, in a state where variable displacement compressor 100 is not operated, communication path 145 is forcibly opened by turning off the supply of electricity to the solenoid incorporated in control valve 300, thereby controlling the displacement for discharge of variable displacement compressor 100 to a minimum.

(2) Variable-Angle Moment that Acts on Swash Plate

The variable-angle moment that acts on swash plate 111 at the time of operating the variable displacement compressor 100 is as follows.

A moment MCL caused by the cylinder pressures acting on respective pistons (in the inclination angle increasing direction)

A moment MCR caused by the pressure in the crank chamber acting on respective pistons (in the inclination angle decreasing direction)

A moment MP caused by the inertial forces of reciprocal motions of pistons (in the inclination angle increasing direction)

A moment MS of rotational movement based on the setting of the product of inertia in the variable-angle direction of the swash plate A moment MF caused by the combined force of the urging force of the inclination angle decreasing spring and the urging force of the inclination angle increasing spring When the air conditioning system is operated, the moments of gas pressure (MCR-MCL) are generally greater than the other mechanical moments (MP, MS, MF), therefore it is possible to give less consideration to the mechanical moments. However, because the moment MP and the moment MS are functions containing the square of the rotational speed, the moment MP and the moment MS cannot be ignored in the high-speed rotation region.

In particular, because the moments of gas pressure (MCL, MCR) become quite small in an OFF state of the clutchless compressor (at the time when the air conditioning system is not operated), the variable-angle motion of swash plate 111 becomes easy to be affected the mechanical moments (MP, MS, MF).

Figure 3:
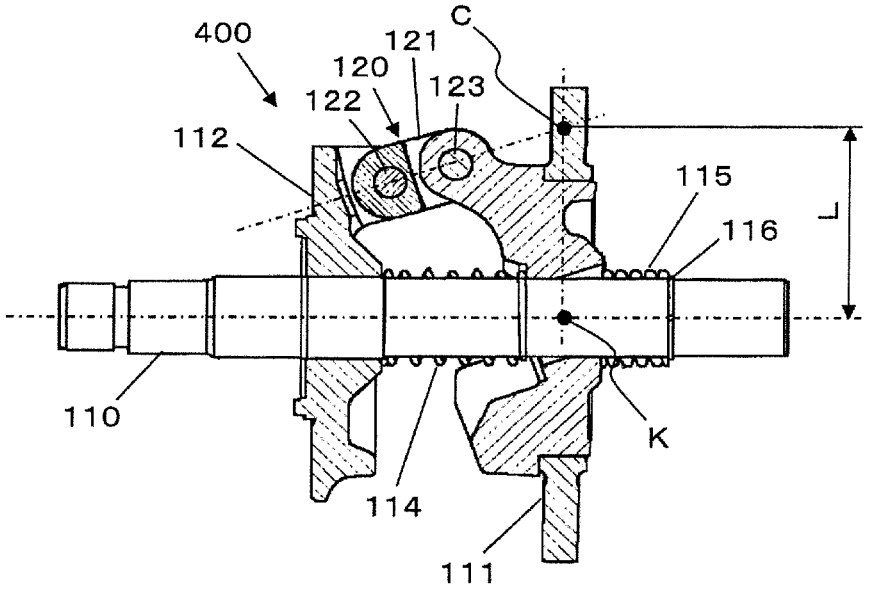
FIG. 3 is a vertical sectional view of a linking body in the variable displacement compressor depicted in FIG. 1.

The moments, the values of which are adjustable, among the mechanical moments are the moment MF and the moment MS. The moment MF can be adjusted by the urging forces of inclination angle decreasing spring 114 and inclination angle increasing spring 115 and their spring constants, and, in this embodiment, it can be calculated from a product of the urging force F shown in FIG. 2 and a distance L between a momentary rotation center C at an arbitrary inclination angle of swash plate 111, which is defined depending upon its design as shown in FIG. 3, and the axial center of drive shaft 110 (MF=F·L). Where, the momentary rotation center is an intersection between a line orthogonal to the axial line of drive shaft 110 through a rotational center (point K) of swash plate 111 and an axial line determined through a center of first link pin 122 and a center of second link pin 123 in a linking body 400 of drive shaft 110 on which inclination angle decreasing spring 114 and inclination angle increasing spring 115 are mounted, rotor 112, link mechanism 120 and swash plate 111 shown in FIG. 3.

Figure 4:
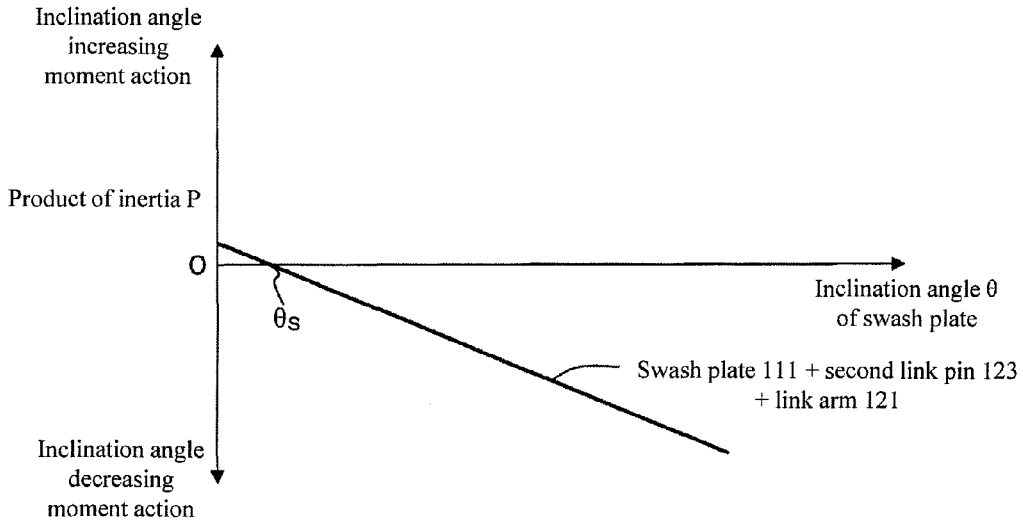
FIG. 4 is a graph showing characteristics of a product of inertia in a variable-angle direction of a swash plate in the variable displacement compressor depicted in FIG. 1.

Further, the moment MS can be adjusted by the shape, the mass and the center of gravity of swash plate 111, that is, the setting of the product of inertia, and, in this embodiment, it can be calculated from the value of product of inertia P shown in FIG. 4 using an equation MS=P·ω2 (where, ω is an angular speed of rotation of the drive shaft).

FIG. 4 shows the product of inertia in the variable-angle direction of swash plate 111 including influences due to link pin 123 and link arm 121.

Since second link pin 123 is press-fitted into swash plate 111, it is integrated with swash plate 111. Link arm 121 rotates around a center of first link pin 122 and changes in its position in correspondence with the change of inclination angle of swash plate 111. When drive shaft 111 is rotated, since a moment of rotational movement acts on a portion around the center of first link pin 122 by link arm 121, link arm 121 causes a moment of rotational movement by which swash plate 111 is directed toward the inclination angle increasing direction all the time via second link pin 123. Therefore, in consideration of the moment of rotational movement in the inclination angle increasing direction caused by link arm 121, the product of inertia of the linking body of second link pin 123 and swash plate 111 is set to exhibit such a property as shown in FIG. 4. Namely, because the value of product of inertia P is configured by two factors of link arm 121 and the linking body of second link pin 123 and swash plate 111, it exhibits a range of variation broader than that in other hinge structures having no link arm 121.

Where, the inclination angle θs of the swash plate at which the value of product of inertia P becomes zero is set in a range greater than 0° and smaller than 1°.

(3) Inclination Movement of Swash Plate by Moment MF and Moment MS

Figure 5:
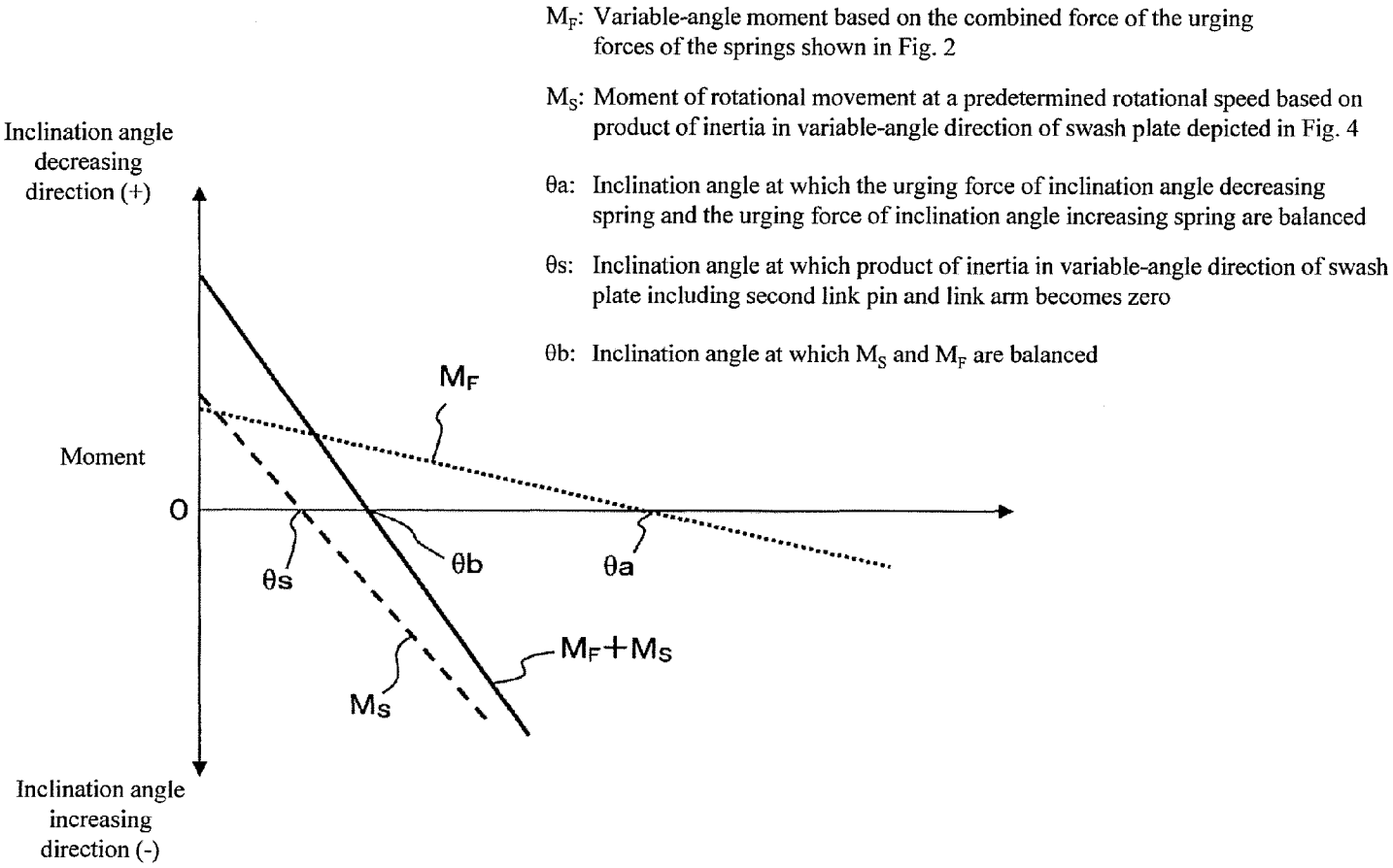
FIG. 5 is a graph showing a relationship between a moment MF and a moment MS at the time when a linking body is rotated in the variable displacement compressor depicted in FIG. 1.
Figure 6:
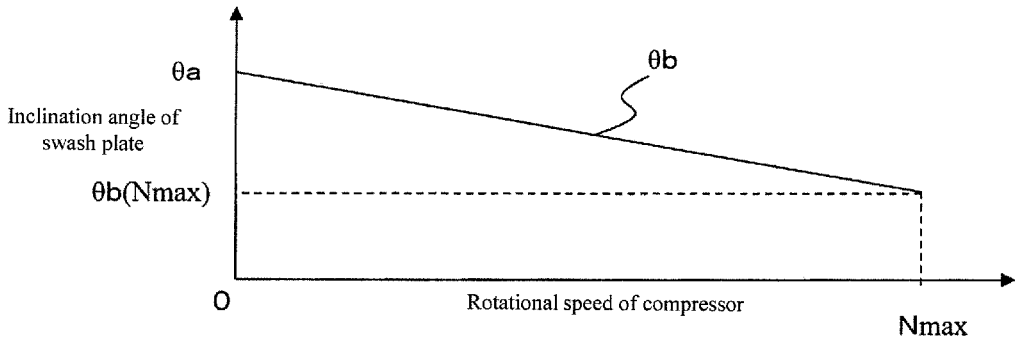
FIG. 6 is a graph indicating a relationship between an inclination angle θb of a swash plate and a rotational speed of a compressor at the time when a linking body is rotated in the variable displacement compressor depicted in FIG. 1.

Next, with reference to FIG. 5 and FIG. 6, it will be explained how the inclination angle of swash plate 111 is positioned by the moment MF and the moment MS at the time when linking body 400 of drive shaft 110 on which inclination angle decreasing spring 114 and inclination angle increasing spring 115 are mounted, rotor 112, link mechanism 120 and swash plate 111 is rotated.

For example, a case is considered where variable displacement compressor 100 is operated at a condition where cylinder head 104, valve plate 103, discharge valve, suction valve and pistons 136 are removed from the compressor under atmospheric pressure. In this condition, only the moment MF and the moment MS act on the swash plate because the moment of gas pressure (MCR-MCL) and the moment MP become zero.

Where, inclination angle θ of the swash plate can be determined, for example, by measuring a displacement of swash plate 111 in the axial direction using a laser displacement measuring device at the time when swash plate 111 is rotated. When the position of swash plate 111 at which the laser is irradiated is set at a position corresponding to a pitch circle through which the center axes of respective pistons 136 pass, the measured displacement ΔL of swash plate 111 in the axial direction becomes the piston stroke itself. In this case, when the diameter of the pitch circle is represented by D, a relation between the inclination angle θ and the displacement ΔL of the swash plate is represented by tan θ=ΔL/D, and the inclination angle θ of swash plate 111 can be determined easily by measuring the displacement ΔL of swash plate 111 in the axial direction.

In a state where the rotation of drive shaft 110 is stopped, because a relation MS=0 is satisfied, the inclination angle of swash plate 111 is positioned at the inclination angle θa of swash plate 111 at which the urging force of inclination angle decreasing spring 114 and the urging force of inclination angle increasing spring 115 are balanced.

When drive shaft 110 is rotated from the state where the rotation is stopped up to a predetermined rotational speed, the moment MS of rotational movement based on the product of inertia P in the variable-angle direction of swash plate 111 acts on swash plate 111 to change the inclination angle of swash plate 111 from the inclination angle θa. Where, because a relation θs<θa is satisfied, the moment MS acts in the inclination angle decreasing direction, and the inclination angle of swash plate 111 becomes smaller from the inclination angle θa toward the inclination angle θs.

When the inclination angle of swash plate 111 becomes smaller than the inclination angle θa, since the moment MF caused by the combined force F of the urging forces of springs shown in FIG. 2 acts on swash plate 111 in the inclination angle increasing direction, the inclination angle of swash plate 111 is positioned autonomously at a position where the sum of the moment MF and the moment MS becomes zero (an inclination angle θb). The inclination angle θb approaches to the inclination angle θs as the rotational speed of drive shaft 110 increases, and becomes the smallest angle at the maximum rotational speed (Nmax). The inclination angle θb(Nmax) at the maximum rotation speed is set at a minimum angle in a range of inclination angle where the compression operation is performed securely. Namely, at the maximum rotational speed, a requisite minimum compression operation is securely guaranteed, and the inclination angle of swash plate 111 is prevented from becoming unnecessarily great.

Where, the maximum rotational speed (Nmax) is assumed to be approximately 9000 rpm (±1000 rpm) in a swash plate type variable displacement compressor, for example.

The mechanical minimum inclination angle θmin of swash plate 111 is set at approximately 0°, although there is a possibility that the inclination angle transitionally reaches the minimum inclination angle θmin in the operating state of actual variable displacement compressor 100, because in this state the moment MP and the moment of gas pressure (MCR-MCL) are either zero or quite small, in order to return the displacement for discharge from the minimum inclination angle θmin, the inclination angle θb(Nmax) must be positioned in a region of inclination angle where the compression operation is performed securely by the moment MF and the moment MS.

Usually, when the inclination angle of swash plate 111 becomes small and approaches to approximately 0°, the compression operation is performed insufficiently or is not performed at all under a condition where the inclination angle becomes smaller than a certain inclination angle. Accordingly, when this inclination angle becoming the boundary was determined experimentally, the boundary was recognized to be approximately 0.2°, and it was confirmed that the inclination angle of swash plate 111 at which the compression operation was performed securely was 0.4° or greater.

Figure 7:
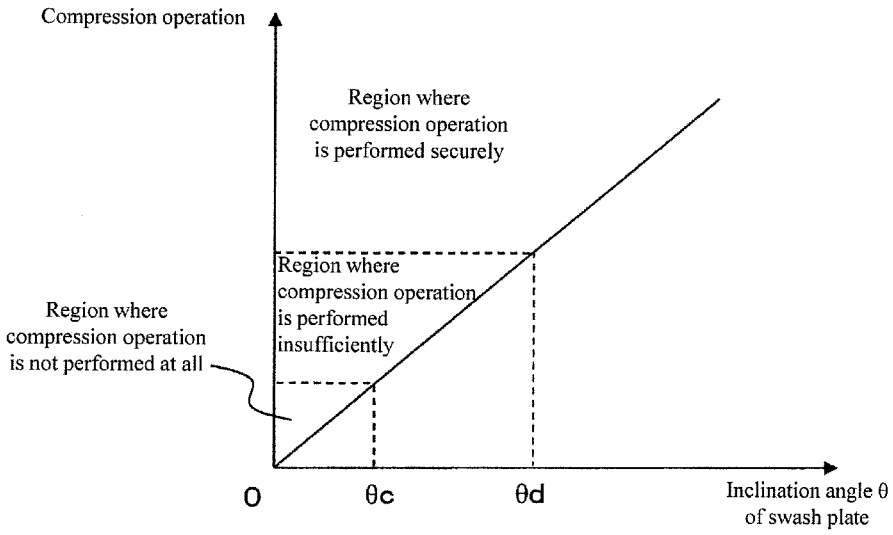
FIG. 7 is a concept diagram showing a state of compression operation at an angle near a minimum inclination angle of a swash plate in the variable displacement compressor depicted in FIG. 1.

Namely, as shown in the concept diagram in FIG. 7 showing a state of compression operation at a position near the minimum inclination angle, when an inclination angle of a boundary between a region where the compression operation is not performed at all and a region where the compression operation is performed insufficiently is represented by θc, and an inclination angle of the boundary between the region where the compression operation is performed insufficiently and a region where the compression operation is performed securely is represented by θd, these regions can be represented as follows.

The region where the compression operation is not performed at all: $0° \leq \theta < \theta c$ The region where the compression operation is performed insufficiently: $\theta c \leq \theta < \theta d$ The region where the compression operation is performed securely: $\theta d \leq \theta$ It is confirmed that θc is approximately 0.2° and θd is 0.4° or greater. Whether the compression operation is performed or not is judged at a rotational speed of the compressor corresponding to an idling state of a vehicle (for example, 700 rpm).

Therefore, it is desirable that the inclination angle θs at which the value of product of inertia P becomes zero in FIG. 4 is approximately 0.4° (in a range of approximately 0.4°±0.3°), and that the above-described inclination angle θb(Nmax) is approximately 1° (in a range of approximately 1°±0.5°), preferably 1° or less (where $\theta s < \theta b$).

In link mechanism 120, although a fluctuation in the inclination angle θb(Nmax) becomes great because a fluctuation of the value of product of inertia P is greater than those of other hinge structures, because there is also a fluctuation in the combined force F of the urging forces of the springs, and further because there are friction forces acting on link mechanism 120 and on a sliding portion between the periphery of drive shaft 110 and through hole 111*c* at the time when swash plate 111 is inclined, since the inclination angle θb(Nmax) is recognized by actually rotating linking body 400, it is possible to securely position the inclination angle θb within a desired range by correcting the value of product of inertia P and the combined force F of the urging forces of the springs so that the inclination angle θb(Nmax) is set at a target inclination angle.

As described above, since the urging force of inclination angle decreasing spring 114, the urging force of inclination angle increasing spring 115 and the product of inertia in the variable-angle direction of swash plate 111 are set so that, when drive shaft 110 is rotated with respect to linking body 400, the inclination angle of swash plate 111 decreases autonomously as the rotational speed increases, by the setting of the product of inertia in the variable-angle direction of swash plate 111, and at the maximum rotational speed, the inclination angle of the swash plate is positioned at a minimum angle in a range of inclination angle where the compression operation is performed securely, such a configuration can contribute efficiently to the reduction in power consumption of the variable displacement compressor in the high-speed rotation region. Further, at the same time, it can contribute to the improvement of lifetime of shaft sealing device 130 because the increase of the pressure in the crank chamber is suppressed.

Where, the above-described value of θs is shown as a value exhibiting a desired state and not limited thereto. For example, even if θs is set at a slightly negative angle (for example, $-0.5° < \theta s < 0°$), the urging forces of the springs may be set so that a desired θb can be obtained according to the sum of the moment MF and the moment MS.

Further, although in the above-described embodiment variable displacement compressor 100 is described as a clutchless compressor, it may also be a variable displacement compressor provided with an electromagnetic clutch. Further, the present invention can be applied to a wobble plate type variable displacement compressor.

Further, the linking means for linking the rotor and the swash plate is not limited to the above-described embodiment. For example, a structure may be employed wherein a slot is formed in a rotor arm, and a pin fixed to a swash plate is linked to the slot.

Further, although the swash plate is supported directly by the drive shaft in the above-described embodiment, a swash plate structure may be employed wherein the swash plate is supported by a swash plate support member (sleeve) which is attached slidably to the drive shaft.

Furthermore, the minimum inclination angle regulating means also is not limited to the above-described embodiment. For example, the minimum inclination angle may be regulated by fixing a snap ring to the drive shaft.

INDUSTRIAL APPLICABILITY

The present invention can be applied to any swash plate type variable displacement compressor which compresses a refrigerant, and in particular, it is suitably applied to a compressor used in an air conditioning system for vehicles.

EXPLANATION OF SYMBOLS

100: variable displacement compressor
101: cylinder block
101*a*: cylinder bore
101*b*: formed wall
101*c*: communication path
102: front housing
102*a*: boss part
103: valve plate
103*a*: suction hole
103*b*: discharge hole
103*c*: orifice
104: cylinder head
104*a*: suction port
104*b*: communication path
105: through bolts
106: lid member
106*a*: discharge port
110: drive shaft
111: swash plate
111*a*: second arm
111*c*: through hole
112: rotor
112*a*: first arm
114: inclination angle decreasing spring
115: inclination angle increasing spring
116: spring support member
120: link mechanism
121: link arm
122: first link pin
123: second link pin
130: shaft sealing device
131, 132: radial bearing
133: thrust bearing
134: thrust plate
135: adjusting screw
136: piston
137: shoe
140: crank chamber
141: suction chamber
142: discharge chamber
143: muffler space
144: communication path
145: pressure supplying path
146: space
200: check valve
300: control valve

The invention claimed is:

1. A variable displacement compressor comprising:

a housing in which a discharge chamber, a suction chamber, a crank chamber and cylinder bores are defined, pistons inserted into said cylinder bores, a drive shaft supported rotatably in said housing, a rotor fixed synchronously rotatably to said drive shaft, a swash plate linked with said rotor via a linking means, the swash plate being configured to rotate synchronously with said rotor and being attached slidably to said drive shaft so that an inclination angle of the swash plate is changeable relative to an axis of said drive shaft, a minimum inclination angle regulating means for regulating a minimum inclination angle of said swash plate to approximately 0°, when said inclination angle of said swash plate orthogonal to said axis of said drive shaft is defined as 0°, an inclination angle increasing spring mounted on said drive shaft and configured to urge said swash plate in a direction of increasing said inclination angle from said minimum inclination angle, an inclination angle decreasing spring mounted on said drive shaft and configured to urge said swash plate in a direction of decreasing said inclination angle from a maximum inclination angle through said minimum inclination angle, a conversion mechanism disposed between said pistons and said swash plate for converting rotational motion of said swash plate into reciprocating movement of said pistons, a control valve for controlling a pressure in said crank chamber, which control valve changes said inclination angle of said swash plate by varying a pressure difference between said crank chamber and said suction chamber to adjust a stroke of said pistons, compresses a refrigerant sucked from said suction chamber into cylinder bores and discharges a compressed refrigerant into said discharge chamber, and a linking body of said drive shaft, wherein said rotor, said linking means and said swash plate are configured so that:

in a case in which said drive shaft is not rotated, said inclination angle of said swash plate is positioned at a predetermined inclination angle θa at which a sum of an urging force of said inclination angle decreasing spring and an urging force of said inclination angle increasing spring becomes zero; and in a case in which said drive shaft is rotated at a position of said predetermined inclination angle θa with the inclination angle of said swash plate, a moment of rotational motion MS based on a setting of a product of inertia in a variable-angle direction of said swash plate, the moment of rotational motion MS being adjustable by setting of a shape, a mass and a center of gravity of said swash plate, acts in said inclination angle decreasing direction to decrease said inclination angle of said swash plate from said predetermined inclination angle θa, and whereby a moment MF based on a combined force of said urging force of said inclination angle decreasing spring and said urging force of said inclination angle increasing spring acts in said inclination angle increasing direction, thereby said inclination angle of said swash plate being positioned autonomously at a predetermined inclination angle θb at which a sum of said moment MS and said moment MF becomes zero, and said sum of said moment MS and said moment MF is set in said inclination angle increasing direction at said minimum inclination angle of approximately 0°, wherein said urging force of said inclination angle increasing spring, said urging force of said inclination angle decreasing spring and said product of inertia in said variable-angle direction of said swash plate are such that said predetermined inclination angle θb is positioned at a minimum angle in a range of inclination angle, such that, at a time of a maximum operational rotational speed of the swash plate, the angle θb balanced by the moment MS due to the product of inertia and the moment MF based on the combined force of said urging force of said inclination angle decreasing spring and said urging force of said inclination angle increasing spring is set at the minimum inclination angle in a case in which compression operation is performed, and wherein said predetermined inclination angle θb is approximately 1°±0.5°.

2. The variable displacement compressor according to claim 1, wherein said linking means is a link mechanism having a link arm for linking said rotor with said swash plate.

* * * * *